US007892359B2

(12) United States Patent
Berner et al.

(10) Patent No.: US 7,892,359 B2
(45) Date of Patent: Feb. 22, 2011

(54) DISHWASHER IN THE FORM OF A PROGRAMMABLE MACHINE AND ITS OPERATING METHOD

(75) Inventors: Dietrich Berner, Waldstetten (DE); Harald Disch, Elzach (DE); Markus Heidt, Kehl (DE)

(73) Assignee: Premark FEG L.L.C., Wilmington, DE (US)

( * ) Notice: Subject to any disclaimer, the term of this patent is extended or adjusted under 35 U.S.C. 154(b) by 93 days.

(21) Appl. No.: 12/334,831

(22) Filed: Dec. 15, 2008

(65) Prior Publication Data

US 2009/0159097 A1 Jun. 25, 2009

(30) Foreign Application Priority Data

Dec. 21, 2007 (DE) ..... 10 2007 062 953

(51) Int. Cl.
*B08B 3/04* (2006.01)

(52) U.S. Cl. ..... 134/10; 134/18; 134/25.1; 134/25.2; 134/26; 134/32; 134/36; 134/42; 134/60; 134/62; 134/84; 134/88; 134/104.2

(58) Field of Classification Search ..... 134/10, 134/18, 25.1, 25.2, 26, 32, 36, 42, 60, 62, 134/84, 88, 104.2
See application file for complete search history.

(56) References Cited

U.S. PATENT DOCUMENTS

| | | | | |
|---|---|---|---|---|
| 3,965,914 | A * | 6/1976 | Walker, Jr. | 134/104.4 |
| 4,156,621 | A * | 5/1979 | Andrews et al. | 134/10 |
| 4,689,089 | A | 8/1987 | Eberhardt, Jr. et al. | |
| 4,805,649 | A | 2/1989 | Nezworski | |
| 4,872,466 | A * | 10/1989 | Noren | 134/57 D |
| 5,617,885 | A * | 4/1997 | Centis | 134/58 D |
| 6,398,495 | B1 * | 6/2002 | Kazianus | 415/206 |
| 6,447,081 | B1 * | 9/2002 | Sargeant et al. | 312/228.1 |
| 2006/0260656 | A1 * | 11/2006 | Berner et al. | 134/56 D |
| 2007/0034240 | A1 * | 2/2007 | Berner et al. | 134/110 |
| 2009/0211611 | A1 * | 8/2009 | Berner et al. | 134/48 |

FOREIGN PATENT DOCUMENTS

| | | | |
|---|---|---|---|
| DE | 102005030720 | | 1/2007 |
| DE | 102005035764 | | 2/2007 |
| DE | 102005038433 | | 2/2007 |
| EP | 0838190 | | 4/1998 |
| EP | 1042983 | | 10/2000 |
| JP | 401052431 | * | 2/1989 |
| JP | 411138440 | * | 5/1999 |
| WO | WO 95/14424 | | 6/1995 |
| WO | WO2007021577 | * | 2/2007 |
| WO | WO2007024491 | * | 3/2007 |

OTHER PUBLICATIONS

European Search Report, EP 08170121, Apr. 8, 2009.
Search Report, DE 10-2007-062-953, Dec. 21, 2007.

* cited by examiner

*Primary Examiner*—Sharidan Carrillo
(74) *Attorney, Agent, or Firm*—Thompson Hine LLP

(57) ABSTRACT

A dishwasher in the form of a programmable machine, in particular a commercial dishwasher, having a pre-cleaning station, which is disposed outside a treatment chamber of the dishwasher, and having a waste water transfer system, by which washing liquid can be fed from a wash tank of the dishwasher as pre-cleaning liquid to the pre-cleaning station.

12 Claims, 2 Drawing Sheets

DISHWASHER IN THE FORM OF A PROGRAMMABLE MACHINE AND ITS OPERATING METHOD

TECHNICAL FIELD

This application relates to an operating method for a dishwasher in the form of a programmable machine, in particular a commercial dishwasher.

BACKGROUND

Dishwashers are frequently also referred to as "warewashers", since they can be used not only to clean dishes and cutlery, but, for example, also to clean pots, pans, trays and similar items. Dishwashers or warewashers may be programmable machines of the box-type. These can be rack push-through machines (hood-type warewashers), or front loaders, particularly under-counter machines.

From EP 0 808 894 B1, a washware cleaning method is known, containing the steps: preliminary cleaning by spraying the washware with a pre-cleaning solution, main cleaning and after-rinse. To the pre-cleaning solution are added at least one alkali component and at least one complexing agent. The document does not state whether the method relates to a programmable machine (box-type warewasher) or a conveyor warewasher.

Commercial dishwashers or utensil washers (commercial warewashers) normally operate in two main process steps, namely first washing with washing liquid and then rinsing clear with heated fresh water, to which rinse aid is added. The washing liquid contains water and added detergent.

In order to be able to perform these two process steps, a commercial dishwasher is normally equipped with two mutually independent liquid systems, which are completely separate from one another. One of these two liquid systems is a washing liquid circuit, which is responsible for washing the washware and is realized with previously used liquid from a wash tank. The other liquid system is a clear-rinsing liquid system, which has a water heater (boiler) for heating fresh water.

The main object of the clear-rinse with clear-rinsing liquid is to remove suds present on the washware. In addition, the clear-rinsing liquid which flows off into the wash tank in the course of the clear-rinse serves to regenerate the washing liquid in the wash tank.

Before new fresh water is supplied for the clear-rinse, the same quantity of washing liquid is pumped off from the wash tank into the on-site waste water system.

One particular type of commercial dishwashers in the form of programmable machines are hood-type dishwashers. Their treatment chamber for the cleaning of washware is surrounded by a hood. The hood can be lifted upwards for the loading of the treatment chamber and can then be lowered again for the treatment of the washware. Hood-type dishwashers are almost always provided with a feed table and a delivery table. The feed table is in many cases configured as a pre-cleaning station for the preliminary cleaning of the washware by rinsing and/or by manual removal of dirt deposits from the washware before this is pushed into the hood-type dishwasher in a washware rack. The preliminary cleaning by pre-rinsing is normally done manually. The pre-rinsing in the course of the preliminary cleaning is generally performed with on-site cold or pre-heated fresh water. In some cases, an additional cleaning chemistry is further used for the pre-rinsing. The delivery table serves for the drying and unloading of the washware racks.

Studies led within the framework of the invention revealed that, for the preliminary cleaning of the washware, depending on the type of washware and its dirt contamination level, about 2 to 3 liters of fresh water are used.

It would be desirable to provide a facility by which the efficiency of the dishwasher can be improved.

SUMMARY

According to one aspect, an operating method is provided for a dishwasher in the form of a programmable machine, in particular a commercial dishwasher, which has a treatment chamber and a pre-cleaning station. In the treatment chamber, washing liquid sprayed through washing nozzles and clear-rinsing liquid sprayed through clear-rinsing nozzles flow into a wash tank, from which the washing liquid can be recirculated to the washing nozzles by means of a washing pump. The pre-cleaning station is disposed outside the treatment chamber and is configured to pre-clean washware by means of pre-cleaning liquid. Waste water from the wash tank is used as pre-cleaning liquid.

The waste water of the wash tank of the dishwasher is used for the automatic, or preferably, for the manual preliminary cleaning or clearing away of washware before this is introduced into the treatment chamber of the dishwasher. Per washware cleaning cycle, the said 2 to 3 liters of fresh water, for example, can thereby be saved. In many cases where pre-heated fresh water and/or an additional cleaning chemistry is used in the prior art, the costs of these additional operating facilities can likewise be saved.

Furthermore, the efficiency of the preliminary cleaning can be significantly improved by the use of warm washing liquid as the pre-cleaning liquid. The washing liquid is a washing liquor, which has a temperature of, for example, between 50° C. and 70° C. and a pH-value of greater than 9 or, at most, greater than 10. Hence, less dirt remains on the washware after the preliminary cleaning and correspondingly less dirt is carried over into the treatment chamber of the dishwasher.

The pre-cleaning liquid is sprayed in the pre-cleaning station onto the washware, preferably through spray nozzles, for example by means of a manually guided spray head.

According to one particular embodiment, it is provided that on-site fresh water is automatically fed as pre-cleaning liquid to the pre-cleaning station if the available quantity of wash tank waste water is insufficient for the preliminary cleaning.

According to a further preferred embodiment, it is provided that the wash tank waste water is first led out of the wash tank into a reservoir, before then being fed from this reservoir to the pre-cleaning station by means of a pump.

According to another, alternative embodiment, it is provided that the wash tank waste water is conveyed directly from the wash tank to the pre-cleaning station by means of a pump.

According to a further preferred embodiment, it is provided that the wash tank waste water is filtered before being reused in the pre-cleaning station.

In another aspect, a dishwasher in the form of a programmable machine, in particular a commercial dishwasher, includes a treatment chamber containing washing nozzles and clear-rinsing nozzles; a wash tank, into which washing liquid sprayed through the washing nozzles and clear-rinsing liquid sprayed through the clear-rinsing nozzles flow and from which washing liquid can be recirculated back to the washing nozzles by means of a washing pump; a pre-cleaning station, which is disposed outside the treatment chamber and is configured to pre-clean the washware by means of pre-cleaning liquid before the washware is cleaned in the treatment chamber, characterized in that a waste water transfer system from the wash tank to the pre-cleaning station is provided for the automatic removal of wash tank waste water from the wash tank and for the supply of the removed wash tank waste water as pre-cleaning liquid to the pre-cleaning station.

BRIEF DESCRIPTION OF THE DRAWINGS

The invention is described below, on the basis of preferred illustrative embodiments, with reference to the appended drawings, in which.

DETAILED DESCRIPTION

Figure 1:
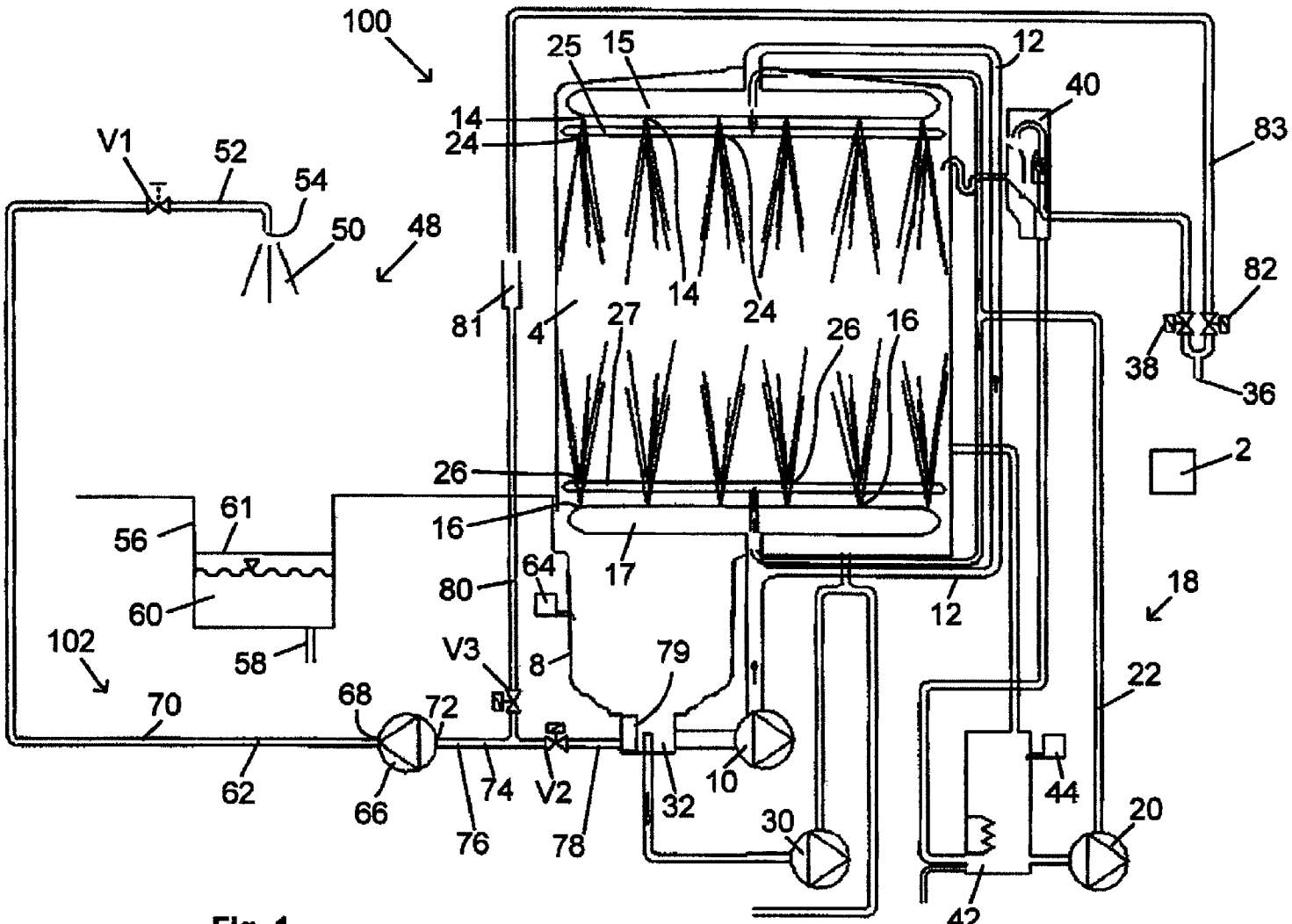
FIG. 1 shows diagrammatically a commercial dishwasher in the form of a programmable machine.
Figure 2:
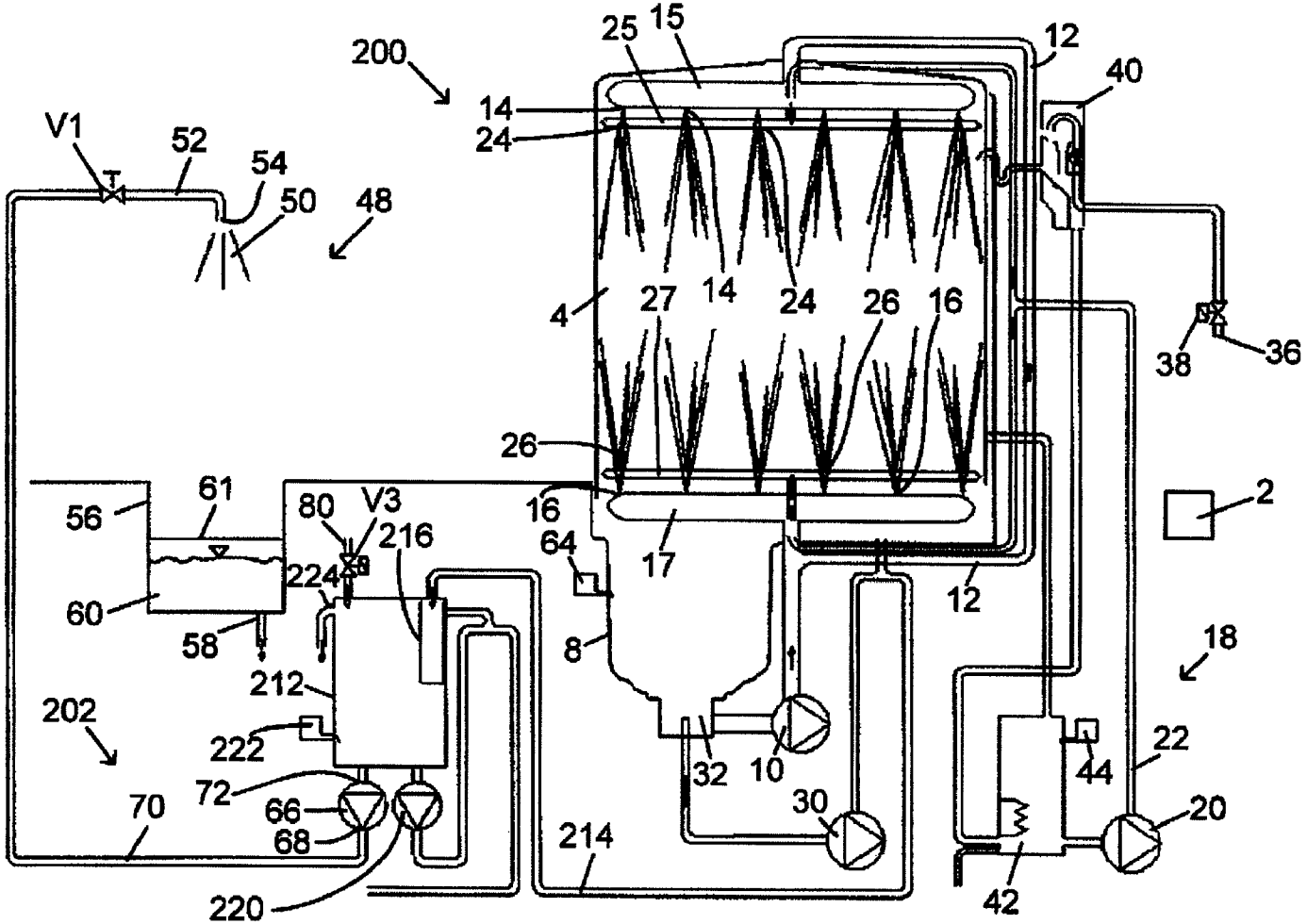
FIG. 2 shows diagrammatically a further embodiment of a commercial dishwasher in the form of a programmable machine according to the invention.

The dishwashers 100 and 200, represented in FIGS. 1 and 2, are commercial dishwashers, which can also be referred to as warewashers and are configured as programmable machines. They contain a program controller 2 for controlling at least one cleaning program and a treatment chamber 4, closable by a door (not shown) or a hood (not shown), for receiving washware to be cleaned (not shown), such as, for example, dishes, cutlery, pots, pans and trays.

Under the treatment chamber 4 there is a wash tank 8 for receiving sprayed liquid from the treatment chamber 4. A washing pump 10 is provided for the conveyance of washing liquid from the wash tank 8 through a washing liquid pipe system 12 to washing nozzles 14 and 16. The washing nozzles 14 and 16 are directed in the treatment chamber 4 onto the region of the washware to be cleaned so as to spray washing liquid onto the washware to be cleaned. The sprayed washing liquid flows back into the wash tank 8 by gravitational force. Hence, the wash tank 8, the washing pump 10, the washing liquid pipe system 12, the washing nozzles 14 and 16 form together with the treatment chamber 4 a washing liquid circuit.

A clear-rinse system 18 contains a clear-rinsing pump 20 for conveying clear-rinsing liquid through a clear-rinse pipe system 22 to clear-rinsing nozzles 24 and 26, which are directed in the treatment chamber 4 onto the region of the washware to be cleaned. The clear-rinsing liquid sprayed by the clear-rinsing nozzles 24 and 26 flows from the treatment chamber 4 into the wash tank 8 by gravitational force. The clear-rinse pipe system 22 connects the pressure side of the clear-rinsing pump 20 to the clear-rinsing nozzles 24 and 26.

The washing nozzles 14 and 16 and the clear-rinsing nozzles 24 and 26 can be disposed above and/or below and, where desired, also to the side of the washware region, and are respectively directed towards the washware region in which, in the treatment chamber 4, the washware can be positioned so as to be cleaned.

Preferably, a multiplicity of washing nozzles 14 is provided on at least one upper washing arm 15, a multiplicity of washing nozzles 16 on at least one lower washing arm 17, a multiplicity of clear-rinsing nozzles 24 on at least one upper clear-rinsing arm 25, and a multiplicity of clear-rinsing nozzles 26 on at least one lower clear-rinsing arm 27.

Before clear-rinsing liquid is sprayed, a quantity of washing liquid corresponding to the quantity of clear-rinsing liquid to be sprayed is respectively pumped off from the wash tank 8 by means of a discharge pump 30, the suction side of which is connected up to a sump 32 of the wash tank 8.

If, prior to a first start-up of the dishwasher, the wash tank 8 is empty, it must first be filled with fresh water via a fresh water pipe (not shown) or by means of the clear-rinse system 18 containing the clear-rinsing pump 20.

The clear-rinsing liquid can be fresh water or fresh water mixed with rinse aid.

The washing liquid contains detergent, which may be added to the liquid contained in the wash tank 8 by a detergent-metering device (not shown).

The dishwashers 100 and 200 of FIGS. 1 and 2 are respectively provided with a fresh water port 36, which is connected up to a fresh water supply network. The fresh water port 36 can be connected via a fresh water supply valve 38 controllable by the controller 2 and via a return flow preventer 40 (air gap) and, preferably, via a water heater 42 to the suction side of the clear-rinsing pump 20. To the fresh water, rinse aid can be added, for example in the water heater 42.

The water heater 42 is provided with at least one level sensor 44 for regulating the liquid level in the water heater 42 by appropriate opening and closing of the fresh water valve 38 by means of the controller 2.

The dishwashers 100 and 200 of FIGS. 1 and 2 are provided with a pre-cleaning station 48, which is disposed outside the treatment chamber 4 and is configured to pre-clean the washware by means of pre-cleaning liquid before the washware is introduced into the treatment chamber 4 in order to be cleaned therein. The washware can be manually cleaned of dirt deposits in the pre-cleaning station and can be rinsed with pre-cleaning liquid 50. For this purpose, the pre-cleaning station 48 contains a dirty water tank 56, an either mechanically positioned or, preferably, manually holdable spray head 52, having at least one or, preferably, a multiplicity of spray nozzles 54 for spraying the pre-cleaning liquid 50 onto the washware to be cleaned. The spray head 52 is located over a dirty water tank 56, which collects the sprayed pre-cleaning liquid 50 and impurities removed from the washware. The dirty water tank 56 is provided with a dirty water discharge 58 for draining dirty water 60 out of the dirty water tank 56. The dirty water tank 56 can be provided with a strainer 61 for trapping dirt particles. The dirty water discharge 58 can also be provided with a strainer.

A waste water transfer system from the wash tank 8 to the spray head 52 of the pre-cleaning station 48 is provided for the automatic removal of wash tank waste water from the wash tank 8 and for the supply of the removed wash tank waste water as pre-cleaning liquid 50 to the pre-cleaning station 48. FIGS. 1 and 2 show two preferred embodiments of waste water transfer systems, without the invention being limited thereto.

The dishwasher 100 of FIG. 1 is provided with a waste water transfer system 102, which has a transfer pipe 62 which connects the wash tank 8 from a point situated below a wash tank level sensor 64, preferably from the sump 32, to the spray head 52 and contains a transfer pump 66 for conveying pre-cleaning liquid from the wash tank to the spray head 52. The transfer pipe 62 has a transfer pipe portion 70, which connects the pressure side 68 of the transfer pump 66 to the spray head 52 and the downstream end of which can be flow-connected or disconnected, via a valve V1, to or from the spray head 52. The valve V1 can be located at the end of the transfer pipe portion 70 or upstream of this, or preferably on the spray head 52.

The suction side 72 of the transfer pump 66 can be connected via a transfer pipe portion 74, and a further valve V2 disposed therein, to the wash tank 8, preferably to its sump 32. The further valve V2 divides the transfer pipe portion 74 into a pipe part 76 and a pipe part 78. A fresh water supply pipe 80 can be connected via a fresh water supply valve V3 to the suction side 72 of the transfer pump 66. The fresh water supply pipe 80 can be connected via a second return flow preventer 81 and a second fresh water valve 82 of a fresh water branch pipe 83 to the fresh water port 36.

Hence, in the dishwasher 100 of FIG. 1, the wash tank 8 can be connected by means of the waste water transfer system 102 directly to the spray head 52 of the pre-cleaning station 48, without intermediate storage of the washing liquid removed as pre-cleaning liquid from the wash tank 8.

In the embodiment represented in FIG. 1, when the valve V1 is actuated by an operator, a part of the waste water (wash water) which cyclically accrues in the wash tank 8 is removed as pre-cleaning liquid from the wash tank 8 by means of the transfer pump 66 and fed to the spray head 52. In this regard, the whole of the washing liquid must not be removed from the wash tank 8, since at least a part thereof is required for the next washing operation. The minimum quantity of washing liquid remaining in the wash tank 8 is monitored, for example, by the wash tank level sensor 64, which generates a signal whenever the liquid level in the wash tank 8 has fallen to the level of the level sensor 64 or falls below this. As in the prior art, the residual liquid quantity in the wash tank 8 can be pumped off, however, by means of the discharge pump 30.

When the valve V1 is manually actuated (or, according to another, non-illustrated embodiment, when the valve V1 is automatically actuated), the transfer pump 66 is switched on and the valve V2 opened, and washing liquid conveyed as pre-cleaning liquid from the wash tank 8 to the spray head 52.

If, during the preliminary cleaning in the pre-cleaning station 48, more than the maximally permitted quantity of washing liquid, defined by the wash tank sensor 64, is required as pre-cleaning liquid, then, in dependence on the signal of the wash tank level sensor 64, the valve V2 in the transfer pipe portion 74 on the suction side of the transfer pump 66 is automatically closed by the controller 2 and afterwards, or at earliest simultaneously, the valve V3 of the fresh water supply pipe 80 is opened, whereupon, at earliest simultaneously, the fresh water valve 82 of the fresh water branch pipe 83 is also opened. The valve V3 then supplies the pre-cleaning station 48, in particular the spray head 52, with fresh water from the fresh water supply pipe 80 via the transfer pump 66. The fresh water valve 82 and the valve V3 can be reclosed and afterwards, or at earliest simultaneously, the valve V2 can be reopened once the liquid level in the wash tank 8 has risen back above the wash tank level sensor 64.

The waste water transfer system 102 of FIG. 1 can contain a filter 79 for filtering the wash water used as pre-cleaning liquid.

In the embodiment represented in FIG. 2, a waste water transfer system 202 is provided, which once again contains the transfer pump 66, the transfer pipe portion 70 and the valve V1, which latter is disposed in the transfer pipe portion 70 or at the end thereof, or preferably on the spray head 52, and can be manually operated to flow-connect the pressure side 68 of the transfer pump 66 to the spray head 52. The suction side 72 of the transfer pump 66 is not connected directly to the wash tank 8, however, but rather to a reservoir 212, preferably to the lower end of the reservoir 212. The discharge pump 30, which with its suction side is connected up to the sump 32 of the wash tank 8, is with its pressure side not connected up to a domestic waste water system, but rather, via a connecting pipe 214, preferably via a removable strainer 216, is flow-connected to the reservoir 212 for the transfer of washing liquid from the wash tank 8 into the reservoir 212, in the manner previously described with reference to FIG. 1, in dependence on the liquid level in the wash tank 8, which level is monitored by the wash tank level sensor 64.

Connected up to the lower end of the reservoir 212 is a second discharge pump 220 for emptying the reservoir 212 into a domestic waste water system, in particular into the sewage system.

In the embodiment of FIG. 2, the fresh water supply pipe 80, which was described with reference to FIG. 1, is flow-connected via its fresh water supply valve V3 to the reservoir 212. The fresh water supply valve V3 is controlled by the controller 2 in dependence on whether the liquid level in the reservoir 212 has fallen to or below the level of a reservoir level sensor 222, or is higher.

The reservoir 212 can be provided with a safety overflow 224.

In the embodiment represented in FIG. 2, the whole of the waste water of the wash tank 8 is removed from the wash tank 8 by means of the discharge pump 30 and pumped into the reservoir 212. The waste water is filtered through the preferably removable filter 216 (strainer), before flowing into the reservoir 212. From the reservoir 212, when the valve V1 is manually actuated (or, according to another, non-illustrated embodiment, when the valve V1 is automatically actuated), the transfer pump 66 is switched on and the stored waste water is conveyed as pre-cleaning liquid from the reservoir 212 to the spray head 52. The reservoir 212 is provided with the reservoir level sensor 222, the effect of which is that the fresh water supply valve V3 of the fresh water supply pipe 80 is respectively only opened, and hence fresh water led into the reservoir 212, when the liquid level in the reservoir 212 falls below the lower liquid level limit defined by the reservoir level sensor. The maximum upper liquid level in the reservoir 212 is defined by its overflow 224. With a second discharge pump 220, the suction side of which is connected to the reservoir 212, the reservoir 212 can be emptied.

In the embodiment of FIG. 2, instead of or in addition to the filter 216, a filter can also be provided elsewhere so as to filter the washing liquid removed from the wash tank 8 on its way to the reservoir 212. Instead of or in addition to this, a filter can also be provided on the path of the pre-cleaning liquid from the reservoir 212 to the spray head 52.

What is claimed is:

1. An operating method for a commercial dishwasher in the form of a programmable machine, which has a treatment chamber and a pre-cleaning station, wherein, in the treatment chamber, washing liquid sprayed through washing nozzles in a warewash region of the treatment chamber and clear-rinsing liquid sprayed through clear-rinsing nozzles in the warewash region of the treatment chamber both flow into a common wash tank, from which the washing liquid can be recirculated to the washing nozzles by means of a washing pump, and wherein the pre-cleaning station is disposed outside the treatment chamber and is configured to pre-clean washware by means of pre-cleaning liquid, characterized in that waste water from the common wash tank is delivered to the pre-cleaning station and used as pre-cleaning liquid on washware prior to the washware being placed into the treatment chamber.

2. The method according to claim 1, characterized in that on-site fresh water is automatically fed as pre-cleaning liquid to the pre-cleaning station if the available quantity of the waste water from the common wash tank is insufficient to pre-clean the washware.

3. The method of claim 1 wherein the pre-cleaning station is a manual pre-cleaning station wherein the washware are manually pre-cleaned by manual control of spraying of pre-cleaning liquid.

4. The method according to claim 2, characterized in that the waste water is first led out of the common wash tank into a reservoir, before then being fed from this reservoir to the pre-cleaning station by means of a pump.

5. The method according to claim 2, characterized in that the waste water is conveyed directly from the common wash tank to the pre-cleaning station by means of a pump.

6. The method according to claim 2, characterized in that the waste water from the common wash tank is filtered before being reused in the pre-cleaning station.

7. A dishwasher in the form of a programmable machine, comprising an internal treatment chamber containing both washing nozzles and clear-rinsing nozzles that spray into a warewash region of the treatment chamber; a wash tank, into which both washing liquid sprayed through the washing nozzles and clear-rinsing liquid sprayed through the clear-rinsing nozzles flow and from which the washing liquid can be recirculated back to the washing nozzles by means of a washing pump; an external pre-cleaning station, which is disposed outside the internal treatment chamber and is configured to pre-clean washware by means of pre-cleaning liquid before the washware is delivered into the internal treatment chamber for cleaning, characterized in that a waste water transfer system from the wash tank to the external pre-cleaning station is provided for the automatic removal of waste water from the wash tank and for the supply of the removed waste water as pre-cleaning liquid to the external pre-cleaning station.

8. A dishwasher according to claim 7, characterized in that a fresh water supply system is provided for automatically feeding on-site fresh water as pre-cleaning liquid to the external pre-cleaning station, whenever a demand signal for pre-cleaning liquid is obtained from the external pre-cleaning station, yet the available quantity of waste water has reached or fallen below a preset lower value.

9. A dishwasher according to claim 8, characterized in that the waste water transfer system has a reservoir, which is arranged to receive waste water from the wash tank and from which liquid can be fed as pre-cleaning liquid to the external pre-cleaning station by means of a pump.

10. A dishwasher according to claim 8, characterized in that the waste water transfer system has a pump in a transfer pipe from the wash tank to the external pre-cleaning station, by means of which waste water can be conveyed as pre-cleaning liquid directly, without intermediate storage, from the wash tank to the external pre-cleaning station.

11. A dishwasher according to one of claim 8, characterized in that the waste water transfer system has a filter for filtering the waste water on the way from the wash tank to the pre-cleaning station.

12. A method of cleaning wares, comprising:

providing a dishwasher having a treatment chamber with both washing nozzles and clear-rinsing nozzles, the dishwasher having ware inlet opening;

spraying washing liquid through the washing nozzles while first wares are in a washware region of the treatment chamber;

collecting the sprayed washing liquid in a wash tank that is below the treatment chamber and from which the washing liquid can be recirculated to the washing nozzles via a washing pump;

spraying clear-rinsing liquid through the clear-rinsing nozzles while the first wares are in the washware region such that both washing and rinsing occur in the washware region;

collecting the sprayed clear-rinsing liquid in the wash tank;

providing a manual pre-cleaning station outside the ware inlet opening of the dishwasher and having a spraying mechanism for manually controlling spraying of pre-cleaning liquid; and delivering waste water from the wash tank to the pre-cleaning station and manually effecting spraying the waste water as pre-cleaning liquid onto second wares at the pre-cleaning station prior to placement of the second wares into the treatment chamber.

* * * * *